US008727481B2

(12) United States Patent
von Essen

(10) Patent No.: US 8,727,481 B2
(45) Date of Patent: May 20, 2014

(54) PRINTHEAD MODULE

(71) Applicant: FUJIFILM Corporation, Tokyo (JP)

(72) Inventor: Kevin von Essen, San Jose, CA (US)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 13/799,245

(22) Filed: Mar. 13, 2013

(65) Prior Publication Data

US 2013/0293630 A1 Nov. 7, 2013

Related U.S. Application Data

(60) Provisional application No. 61/641,687, filed on May 2, 2012.

(51) Int. Cl.
*B41J 2/165* (2006.01)

(52) U.S. Cl.
USPC ..... 347/22

(58) Field of Classification Search
CPC .... B41J 2/14; B41J 2/165; B41J 2002/14362; B41J 2002/14411; B41J 2/162; B41J 2/1721
USPC ..... 347/22
See application file for complete search history.

(56) References Cited

U.S. PATENT DOCUMENTS 6,394,571 B1 * 5/2002 Yano et al. ..... 347/17

* cited by examiner

*Primary Examiner* — Alessandro Amari
*Assistant Examiner* — Michael Konczal
(74) *Attorney, Agent, or Firm* — Fish & Richardson P.C.

(57) ABSTRACT

A printhead module includes a substrate and a head mount. The substrate includes a bottom surface having a plurality of nozzles formed therein and a top surface on a side of the substrate opposite the bottom surface. The substrate includes a plurality of actuators. Each actuator of the plurality of actuators is configured to cause a fluid to be ejected from a nozzle of the plurality of nozzles. The head mount is secured to the substrate and extends over the top surface of the substrate. The head mount includes a first side surface extending upwardly from the bottom surface and a groove formed in the first side surface. The groove is sized and shaped to cause fluid on the first side surface to be drawn by capillary action into the groove.

20 Claims, 5 Drawing Sheets

PRINTHEAD MODULE

PRIORITY CLAIM

This application claims the benefit of U.S. Provisional Patent Application No. 61/641,687, filed May 2, 2012. The entire contents of the foregoing are incorporated herein by reference.

TECHNICAL FIELD

This disclosure relates to a print head module having a groove for waste fluid.

BACKGROUND

A fluid ejection system, for example, an ink jet printer, typically includes an ink path from an ink supply to an ink nozzle assembly that includes nozzles from which ink drops are ejected. Ink is just one example of a fluid that can be ejected from a jet printer. Ink drop ejection can be controlled by pressurizing ink in the ink path with an actuator, for example, a piezoelectric deflector, a thermal bubble jet generator, or an electrostatically deflected element. Atypical printhead module has a line or an array of nozzles with a corresponding array of ink paths and associated actuators, and drop ejection from each nozzle can be independently controlled. In a so-called "drop-on-demand" printhead module, each actuator is fired to selectively eject a drop at a specific location on a medium. The printhead module and the medium can be moving relative one another during a printing operation.

In some systems, multiple printhead modules can be positioned in a row across the medium and perpendicular to the direction of travel of the medium in order to provide single-pass printing on the medium. In addition, multiple printhead modules can be positioned along the direction of travel of the medium to increase overall rate of printing output or to print multiple colors of ink onto the medium.

SUMMARY

During operation or maintenance of the fluid ejection system, ejected fluid can become trapped and accumulate in a gap between adjacent printhead modules. Without being limited to any particular theory, fluid can leak from the nozzles in the printhead, or fluid ejected from the printhead can be reflected back onto the printhead. The presence of such fluid is generally undesirable. For example, the fluid can drip, leaving undesired large spots of ink on the medium. In addition, the fluid can dry, creating debris or particulates. A technique to address these problems is to provide the print head module with a groove that can carry away waste fluid, e.g., by capillary action.

In one aspect, a printhead module includes a substrate and a head mount. The substrate includes a bottom surface having a plurality of nozzles formed therein and a top surface on a side of the substrate opposite the bottom surface. The substrate includes a plurality of actuators. Each actuator of the plurality of actuators is configured to cause a fluid to be ejected from a nozzle of the plurality of nozzles. The head mount is secured to the substrate and extends over the top surface of the substrate. The head mount includes a first side surface extending upwardly from the bottom surface and a groove formed in the first side surface. The groove is sized and shaped to cause fluid on the first side surface to be drawn by capillary action into the groove.

Implementations of this aspect may include one or more of the following features. For example, the head mount may include a second side surface extending upwardly from the bottom surface. The second surface may be at a non-zero angle to the first side surface and may be connected to the first side surface at a first corner. The groove may extend around the corner onto the second side surface. The head mount may include an upper surface substantially parallel to the bottom surface. The first side surface may extend from the upper surface to the bottom surface. The groove may have a first end on the second side surface. The groove may extend along an entire length of the first side surface. The head mount may include a third side surface extending upwardly from the bottom surface. The third side surface may be at a non-zero angle to the first side surface and may be connected to the first side surface at a second corner at a far end of the first side surface from the first corner. The groove may extend around the second corner onto the third side surface. The groove may have a second end on the third side surface. The second side surface may be parallel to the third side surface. The printhead module may further include an absorbent material in contact with a portion of the groove on the second side surface. The printhead module may further include an absorbent material in contact with a portion of the groove. The first side surface may include a first outer surface, a second outer surface above and recessed relative to the first outer surface, and a ledge surface connecting the first outer surface to the second outer surface. The ledge surface may have a width between 0.1 and 1 mm. The ledge surface may have a width of about 0.25 mm. A first edge between the second outer surface and the ledge surface may have a first radius of curvature. A second edge between the ledge surface and the first outer surface may have a second radius of curvature greater than the first radius of curvature. A first edge between the second outer surface and the ledge surface may have a first radius of curvature less than 0.1 mm. A second edge between the ledge surface and first outer surface may have a second radius of curvature greater than 0.5 mm. The head mount may have substantially the same coefficient of thermal expansion as the substrate.

In another aspect, a printhead assembly includes a plurality of printhead modules arranged in a row. Each printhead module of the plurality of printhead modules includes a substrate and a head mount. The substrate includes a bottom surface having a plurality of nozzles formed therein and a top surface on a side of the substrate opposite the bottom surface. The substrate includes a plurality of actuators, each actuator of the plurality of actuators configured to cause a fluid to be ejected from a nozzle of the plurality of nozzles. The head mount is secured to the substrate and extends over the top surface of the substrate. Adjacent printhead modules of the plurality of the printhead modules are separated by a gap. Each head mount from the adjacent printhead modules includes a side surface extending upwardly from the bottom surface and facing the gap. The side surface of each head mount includes a groove sized and shaped to cause fluid in the gap to be drawn by capillary action into the groove.

Implementations of this aspect may include one or more of the following features. For example, a width of the gap may be 0.3 mm or less. Side surfaces of adjacent printhead modules may be substantially parallel. Each head mount from the adjacent printhead modules may include a second side surface extending upwardly from the bottom surface. The second side surface may be at a non-zero angle to the first side surface and may be connected to the first side surface at a first corner. The groove may extend around the corner onto the second side surface. Second side surfaces of adjacent printhead modules may be substantially coplanar. The printhead assembly may further include an absorbent material in contact or configured to move into contact with a portion of the groove on the second side surface of each head mount of the adjacent printhead modules. The absorbent material may include a laterally extending main portion that contacts the portion of the groove on the second side surface of each head mount portion, and a tapered portion projecting downwardly from the laterally extending main portion. The printhead assembly may further include a motor coupled to the absorbent material and a controller configured to cause the motor to move the absorbent material into contact with the portion of the groove on the second side surface of each head mount.

The details of one or more implementations are set forth in the accompanying drawings and the description below. Other aspects, features and advantages will be apparent from the description and drawings, and from the claims.

DESCRIPTION OF DRAWINGS

Like reference symbols in the various drawings indicate like elements.

DETAILED DESCRIPTION

Figure 1:
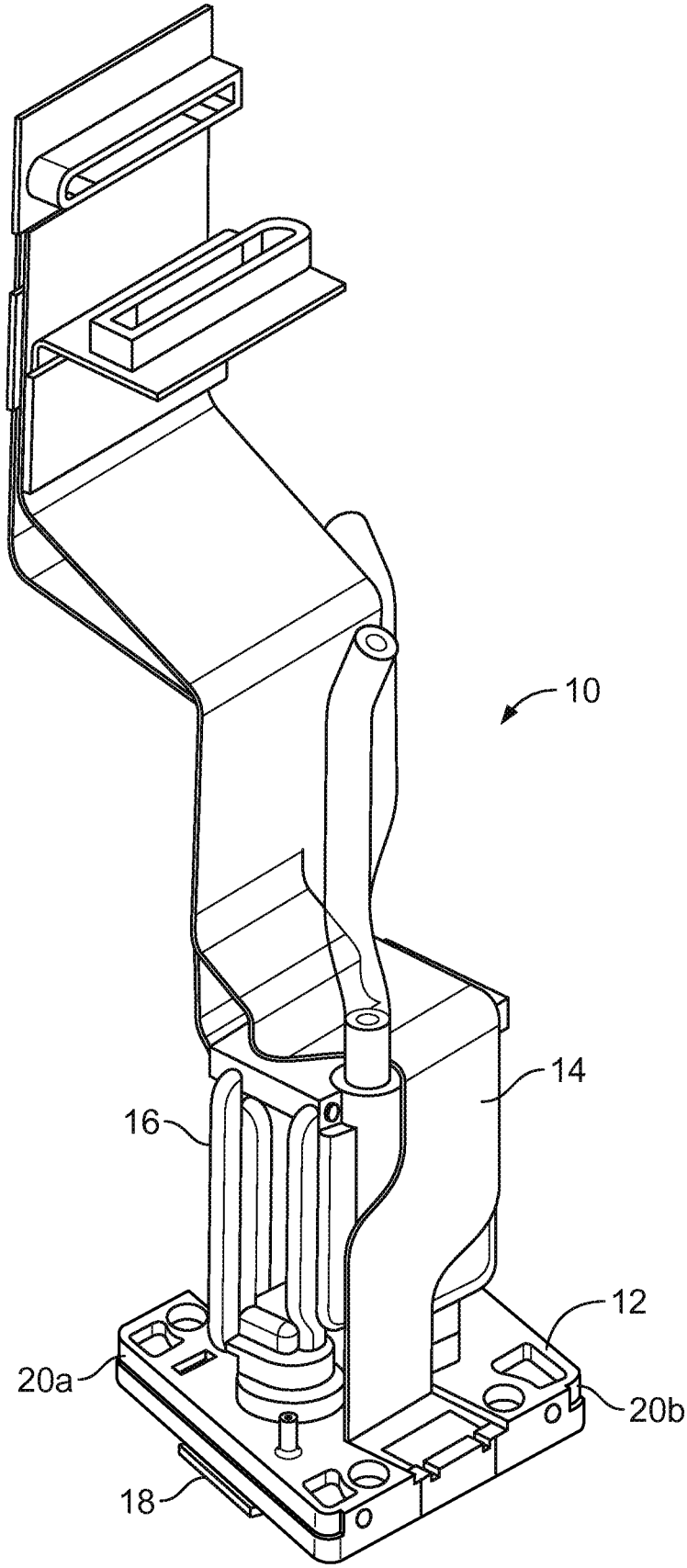
FIG. 1 is a perspective view of a printhead module.

Referring to FIG. 1, a printhead module 10 includes a head mount 12 and a flexible circuit 14 that carries various electrical signals to a substrate 18. The print module 10 also includes a housing 16 that is coupled to an upper surface of the head mount 12 and the substrate 18, e.g., a microfabricated die, that is coupled to a lower portion of the head mount 12. The substrate 18 includes a plurality of nozzles 42 (see FIG. 2C) on a bottom surface and a plurality of actuators 40 (see FIG. 2C) configured to cause drops of fluid, such as ink, to be ejected from the plurality of nozzles. During operation, in order to create a desired image, drops are selectively ejected from the plurality of nozzles while the printhead module 10 moves relative to a medium to be imprinted, e.g., paper. As discussed in detail below, one or more waste fluid grooves 20*a, b* can be formed in a side surface of the head mount 12 to draw in fluid by capillary action.

Figure 2A:
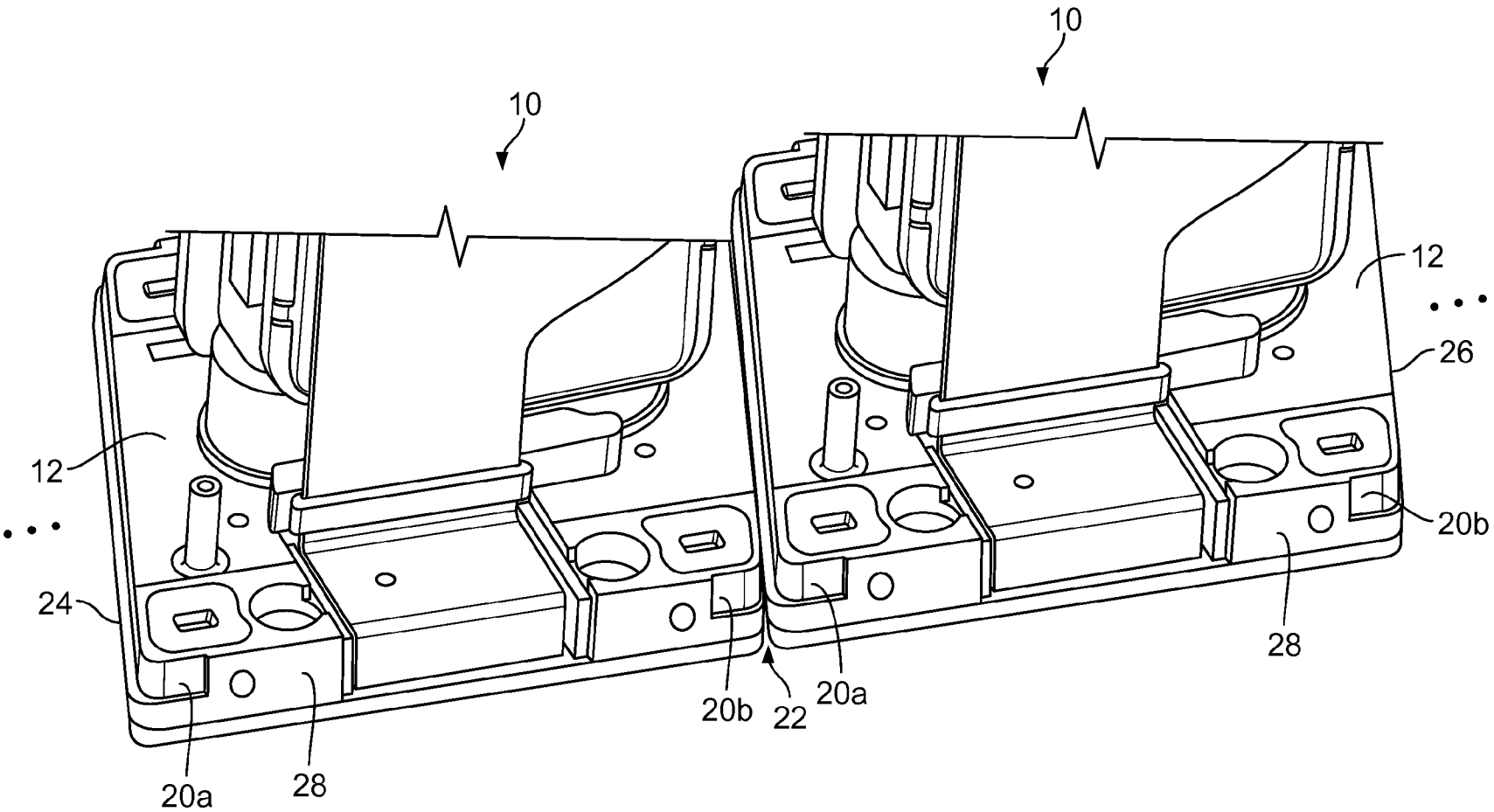
FIG. 2A is a close-up perspective view of multiple printhead modules from FIG. 1 arranged side by side.

As shown in FIG. 2A, a plurality of printhead modules 10 can be mounted side by side on a bar (not shown). In some implementations, the printhead modules 10 can be arranged in a row perpendicular to the direction of motion of the medium. During a maintenance process or, in some cases, during normal printing operation, fluid can enter a gap 22 between adjacent printhead modules 10 and become trapped. For example, wiping the bottom surface of the substrate 18 with a blade during the maintenance process can direct excess fluid into the gap 22 where the fluid is subsequently trapped, e.g., due to capillary forces. Such trapped fluid can be difficult to remove due to the typically small size of the gap 22 and can cause damage to the module 10, for example, if the trapped fluid contacts application-specific integrated circuits (ASICs) or electrical traces of the module 10. In some cases, the trapped fluid can unexpectedly escape the gap and drip onto the printing medium.

Figure 2B:
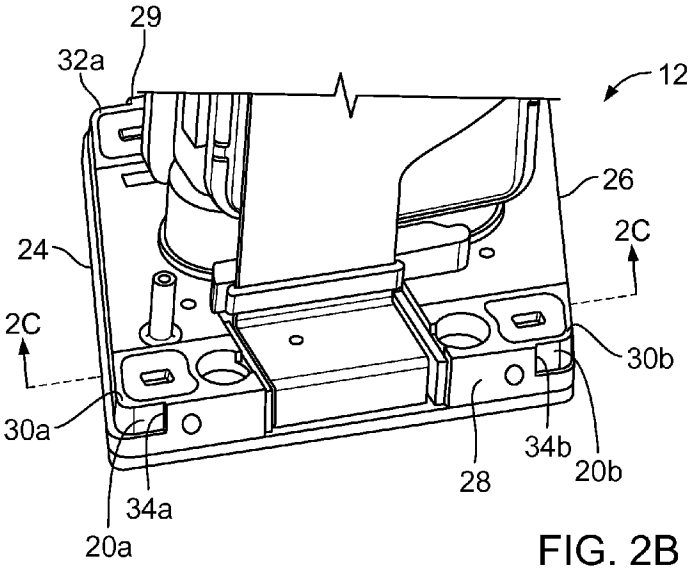
FIG. 2B is a close-up perspective view of the printhead module.
Figure 2C:
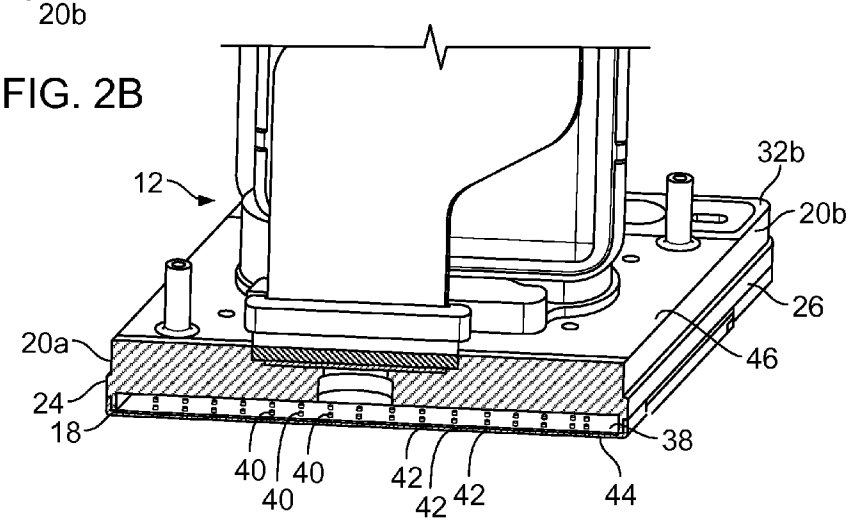
FIG. 2C is a partial cross-sectional view of FIG. 2B.

Referring to FIGS. 2A-2C, the head mount 12 includes an upper surface 46 that is substantially parallel to the bottom surface of the substrate 18, a first side surface 24, a fourth side surface 26 that is on an opposite side of the head mount 12 from the first side surface 24 and generally parallel to the first side surface 24, and a second side surface that provides a front surface 28. The side surfaces 24, 26 are connected, respectively, to opposite ends of the front surface 28 at corners 30*a, b*. The side surfaces 24, 26 are oriented at non-zero angles of, for example, 80 degrees and 110 degrees, respectively, relative to the front surface 28. In some cases, the side surfaces 24, 26 are oriented 90 degrees relative to the front surface 28. Additionally, the head mount 12 can include a third side surface that provides a back surface 29 that is on an opposite side of the head mount 12 from the front surface 28 and is generally parallel to the front surface 28. The side surfaces 24, 26 are connected, respectively, to opposite ends of the back surface 29 at corners 32*a, b*. The side surfaces 24, 26, front surface 28, and back surface are connected to and oriented substantially perpendicularly to the upper surface 46.

As mentioned above, a groove 20*a* can be formed in the side surface 24 of the head mount 12. Similarly, a second groove 20*b* can be formed in the side surface 26. In some cases, one or both of the grooves 20*a, b* can extend along an entire length of side surfaces 24, 26, respectively. Additionally, the groove 20*a* can extend around the corners 30*a*, 32*a* onto the front and back surfaces 28, 29, respectively, terminating at groove ends 34*a*, 36*a* (see FIG. 4B). Similarly, the groove 20*b* can extend around the corners 30*b*, 32*b*, onto the front and back surfaces 28, 29, respectively, terminating at groove ends 34*b*, 36*b* (see FIG. 4B). Various methods may be used to form the grooves 20*a, b* in the head mount 12 including, but not limited to, machining, molding, or die casting. In some cases, the grooves 20*a, b* can be formed by attaching additional materials around the head mount 12. As discussed further below, the head mount 12 can be made from a wide range of suitable materials, for example, moldable ceramic.

Referring particularly to FIG. 2C, the substrate 18 is secured to the lower portion of the head mount 12 such that the head mount 12 extends over a top surface 38 of the substrate 18. The top surface 38 of the substrate 18 includes the plurality of actuators 40 that can force fluid to be ejected from the plurality of nozzles 42 that are positioned at the bottom surface 44 of the substrate 18. The substrate 18 can be secured and positioned relative to the head mount 12 such that the side surface 24, 26 extend from the upper surface 46 of the head mount 12 to the bottom surface 44 of the substrate 18. Additionally, the substrate 18 can be oriented relative to the head mount 12 such that the bottom surface 44 of the substrate 18 is generally parallel to the upper surface 46 of the head mount 12.

Figure 3A:
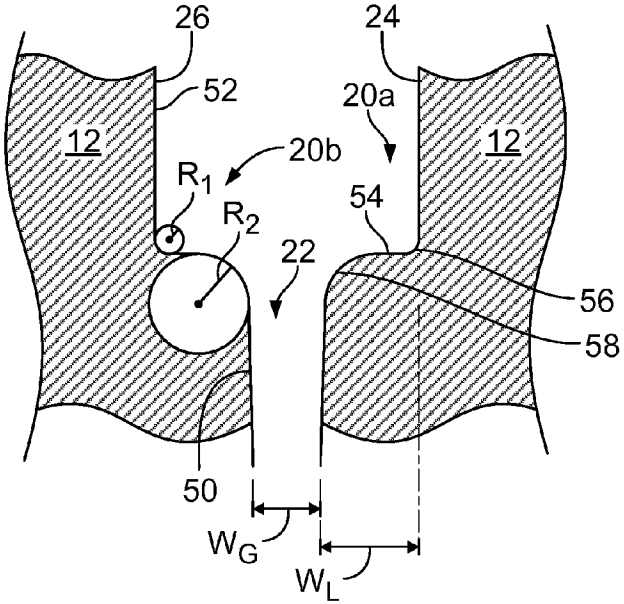
FIGS. 3A and 3B are cross-sectional views of grooves between the printhead modules.
Figure 3B:
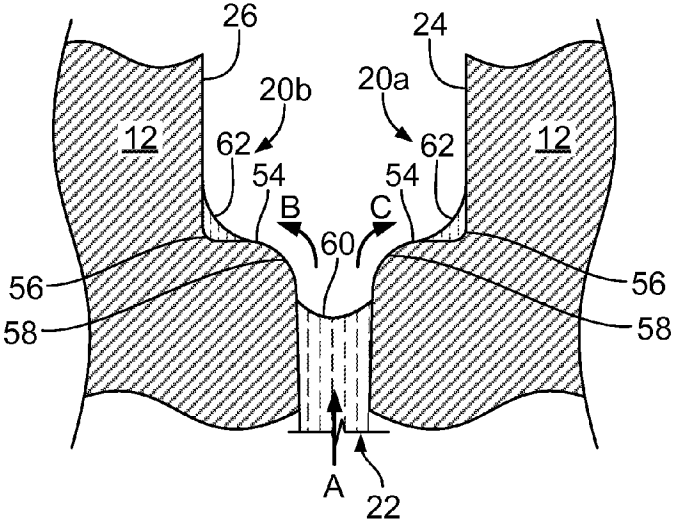

Referring again to FIG. 2A and further to FIGS. 3A and 3B, the gap 22 is formed between side surfaces 24, 26 of adjacent head mounts 12. In some cases, a width, $W_G$, of the gap 22 can be less than 0.3 mm (FIG. 3A).

As shown in the close-up views of the gap region in FIGS. 3A and 3B, grooves 20*a, b* are formed, respectively, in the side surfaces 24, 26. The side surface 24, 26 having the groove 20*a, b* consequently has a lower outer surface 50 and an upper outer surface 52 that is recessed relative to the lower outer surface 50. A ledge surface 54 is positioned between and oriented generally perpendicular to the lower and upper outer surfaces 50, 52. The ledge surface 54 connects to the upper outer surface 52 at an inner edge 56 and connects to the lower outer surface 50 at an outer edge 58. The portion of the groove 20*a, b* that extends to the front and/or back surfaces of the head mount 12 can be configured as described above with respect to the side surface 24, 26.

Various dimensions associated with the groove 20*a, b* can be selected to aid in wicking accumulated fluid out of the gap 22 and into the inner edge 56. In particular, the ledge surface 54 can have a width, $W_L$, of between 0.1 and 1 mm, for example 0.25 mm. A radius of curvature, $R_2$, of the outer edge 58 is greater than a radius of curvature, $R_1$, of the inner edge 56. For example, $R_1$ can be less than 0.1 mm, and $R_2$ can be greater than 0.5 mm. Dimensions of $R_1$ and $R_2$ can be selected such that the accumulated fluid in gap 22 flows along the outer edge 58 and subsequently becomes trapped in the inner edge 56, where a relative sharpness of a corner region at the inner edge 56 can help the fluid to form a meniscus in the region. In some cases, the inner edge 56 can form a sharp corner that forms an acute, right, or obtuse angle.

Referring particularly to FIG. 3B, a flow of accumulated fluid from the gap 22 into grooves 20*a, b* is illustrated. Within the gap 22, accumulated fluid can form a meniscus 60 and travel upward, as indicated by arrow A, due to capillary forces. Upon coming in contact with the outer edge 58, the fluid subsequently flows along the outer edge 58, along the ledge surface 54, and into the inner edge 56, as indicated by arrows B and C. The fluid can flow into one or both of the opposing grooves 20*a, b* and form a meniscus 62 as shown and as discussed above. Wicking away of fluid from the gap 22 into the grooves 20*a, b* as described above can prevent accumulation of fluid in the gap 22. In some cases, fluid can enter the grooves 20*a, b* when the gap 22 as described above is not present, for example, when there is only one printhead module 10.

Referring also to FIG. 2B, due to capillary forces, fluid that becomes trapped in the groove 20*a, b* can travel along a length of the groove 20*a, b* toward the groove ends 34*a, b* located on the front surface 28 and/or toward the groove ends 36*a, b* located on the back surface 29. Fluid that accumulates at the groove ends 34, 36 can then be removed away from the head mount 12 as described below.

Figure 4A:
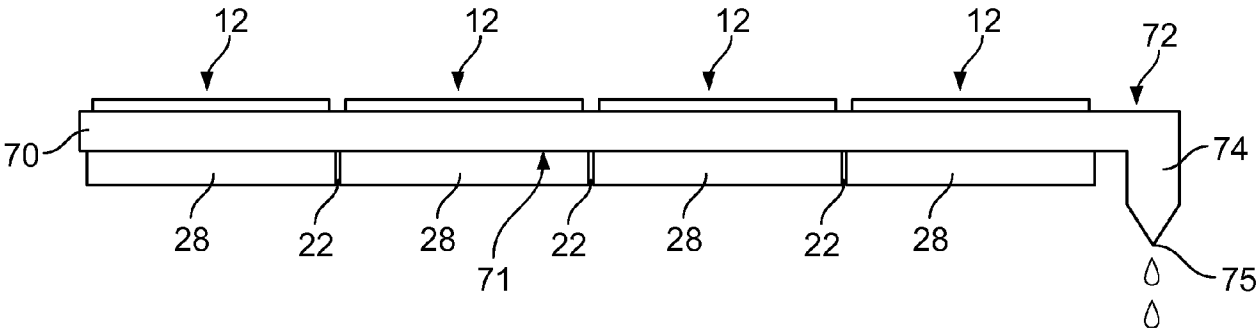
FIG. 4A is a side view of an implementation of the printhead module having a fluid wicking bar.
Figure 4B:
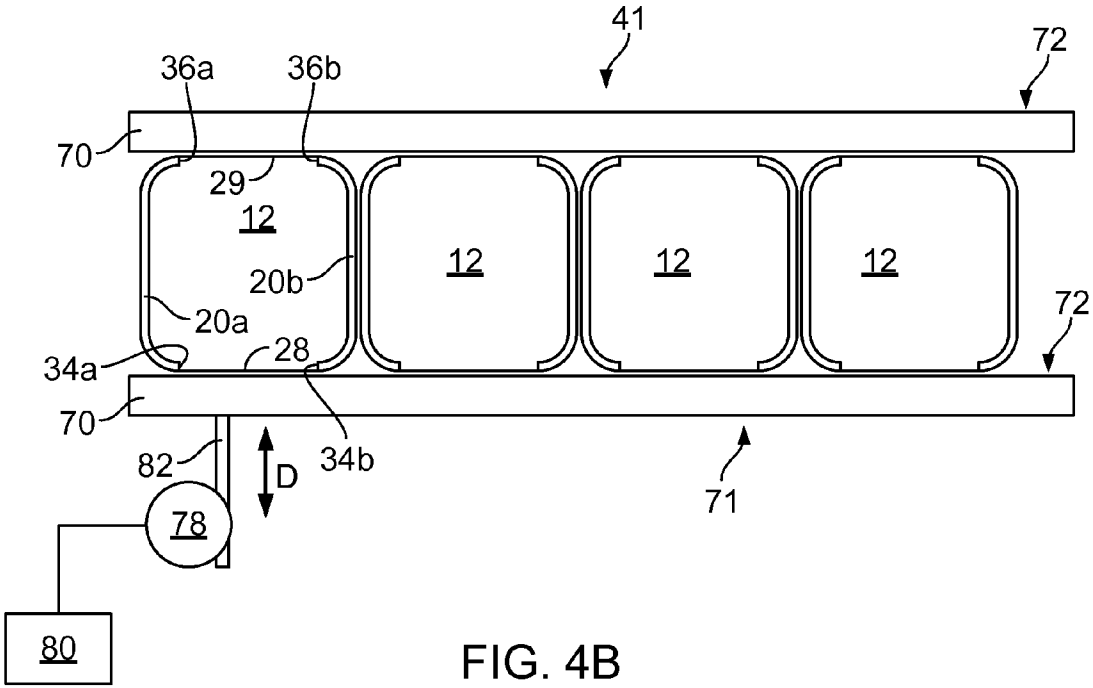
FIG. 4B is a top view of another implementation of the printhead module having the fluid wicking bar.

In some implementations, as illustrated in FIG. 4A, a fluid wicking bar 70 can be placed against the front surface 28 of the head mount 12 to contact the groove ends 34*a, b* (FIG. 4B). The fluid wicking bar 70 has a main portion 71 that extends laterally across the front surface 28. When multiple head mounts 12 are placed side by side, as shown in FIG. 4A, such that their front surfaces 28 are substantially coplanar, the fluid wicking bar 70 can be positioned to simultaneously come in contact with the groove ends 34*a, b* on each head mount 12. Once the fluid wicking bar 70 comes in contact with fluid that has accumulated in the groove ends 34*a, b*, the fluid wicking bar 70 can wick away the fluid along a length of the main portion 71 toward a drainage end 72.

All or portions of the fluid wicking bar 70 can be made from an absorbent material that is configured and adapted to transport fluid away from the head mount 12 and toward the drainage end 72. For example, the fluid wicking bar 70 can be made from felt, cotton, or the like. Additionally, the drainage end can have a tapered portion 74 that projects downwardly from an end of the main portion 71. In operation, the downward orientation and configuration of the tapered portion 74 can create a pressure gradient that drives fluid away from the main portion 71 and toward a drainage tip 75. Alternatively, or additionally, the fluid wicking bar 70 can include channels through which fluid can flow. In some cases, a vacuum can be created in the fluid wicking bar 70 to remove fluid away from the front surface 28 and may or may not include the drainage end 72.

Referring to FIG. 4B, in an alternative implementation, a motor 78 and a motor controller 80 are configured and adapted to move the fluid wicking bar 70 in and out of contact with the front surface 28 of the head mount 12. For example, the motor 78 can be coupled to the fluid wicking bar 70 via a linkage 82 to move the fluid wicking bar 70 in a direction indicated by arrow D. When the fluid wicking bar 70 is not in contact with the portion of the groove 20*a, b* on the front surface 28, fluid from the gap 22 (FIG. 4A) can continue to accumulate, for example, at the groove ends 34*a, b*. When the fluid wicking bar 70 is moved by the motor 78 to come in contact with the accumulated fluid at the groove ends 34*a, b* the accumulated fluid can be wicked away toward the drainage portion 72 as discussed above. In some cases, the fluid wicking bar 70 can additionally or alternatively be positioned against the back surface 29 of the head mount 12 to remove fluid from the portion of the groove 20*a, b* on the back surface 29.

In some implementations, as mentioned above and referring again to FIG. 2C, the head mount 12 can be made from a variety of suitable materials including, but not limited to, moldable ceramic. To reduce warping and stress at bond joints between the head mount 12 and the substrate 18, a material used in the head mount 12 can have a coefficient of thermal expansion (CTE) that is similar to the CTE of the substrate 18, which can be made from, for example, silicon. Additionally, the material of head mount 12 can have a homogeneous CTE such that the head mount 12 expands and contracts uniformly in all directions.

A number of implementations have been described. Nevertheless, it will be understood that various modifications may be made. For example, the configuration and dimensions of the groove 20*a, b* can vary along a length of the groove 20*a, b*. As another example, each head mount 12 can have an integrated element for removing fluid accumulated at the end portions of the groove 20*a, b*. The groove need not extend around the corners. There can be only a single groove on the side surface. Accordingly, other implementations are within the scope of the following claims.

What is claimed is:

1. A printhead module, comprising:

a substrate including a bottom surface having a plurality of nozzles formed therein and a top surface on a side of the substrate opposite the bottom surface, the substrate including a plurality of actuators, each actuator of the plurality of actuators configured to cause a fluid to be ejected from a nozzle of the plurality of nozzles; and a head mount secured to the substrate and extending over the top surface of the substrate, the head mount including a first side surface extending upwardly from the bottom surface, the head mount including a groove formed in the first side surface, the groove sized and shaped to cause fluid on the first side surface to be drawn by capillary action into the groove.

2. The printhead module of claim 1, wherein the head mount includes a second side surface extending upwardly from the bottom surface, the second side surface at a non-zero angle to the first side surface and connected to the first side surface at a first corner, and wherein the groove extends around the corner onto the second side surface.

3. The printhead module of claim 2, wherein the head mount includes an upper surface substantially parallel to the bottom surface, and the first side surface extends from the upper surface to the bottom surface.

4. The printhead module of claim 2, wherein the groove has a first end on the second side surface.

5. The printhead module of claim 4, wherein the groove extends along an entire length of the first side surface.

6. The printhead module of claim 5, wherein the head mount includes a third side surface extending upwardly from the bottom surface, the third side surface at a non-zero angle to the first side surface and connected to the first side surface at a second corner at a far end of the first side surface from the first corner, and wherein the groove extends around the second corner onto the third side surface.

7. The printhead module of claim 6, wherein the groove has a second end on the third side surface.

8. The printhead module of claim 7, wherein the second side surface is parallel to the third side surface.

9. The printhead module of claim 2, further comprising an absorbent material in contact with a portion of the groove on the second side surface.

10. The printhead module of claim 1, further comprising an absorbent material in contact with a portion of the groove.

11. The printhead module of claim 1, wherein the first side surface comprises a first outer surface, a second outer surface above and recessed relative to the first outer surface, and a ledge surface connecting the first outer surface to the second outer surface.

12. The printhead module of claim 11, wherein a first edge between the second outer surface and the ledge surface has a first radius of curvature and a second edge between the ledge surface and the first outer surface has a second radius of curvature greater than the first radius of curvature.

13. The printhead module of claim 1, wherein the head mount has substantially the same coefficient of thermal expansion as the substrate.

14. A printhead assembly, comprising:

a plurality of printhead modules arranged in a row, each printhead module of the plurality of printhead modules including a substrate and a head mount, the substrate including a bottom surface having a plurality of nozzles formed therein and a top surface on a side of the substrate opposite the bottom surface, the substrate including a plurality of actuators, each actuator of the plurality of actuators configured to cause a fluid to be ejected from a nozzle of the plurality of nozzles, the head mount secured to the substrate and extending over the top surface of the substrate;

wherein adjacent printhead modules of the plurality of the printhead modules are separated by a gap, and each head mount from the adjacent printhead modules includes a first side surface extending upwardly from the bottom surface and facing the gap, and the first side surface of each head mount includes a groove sized and shaped to cause fluid in the gap to be drawn by capillary action into the groove.

15. The printhead assembly of claim 14, wherein first side surfaces of adjacent printhead modules are substantially parallel.

16. The printhead assembly of claim 14, wherein each head mount from the adjacent printhead modules includes a second side surface extending upwardly from the bottom surface, the second side surface at a non-zero angle to the first side surface and connected to the first side surface at a first corner, and wherein the groove extends around the corner onto the second side surface.

17. The printhead assembly of claim 16, wherein second side surfaces of adjacent printhead modules are substantially coplanar.

18. The printhead assembly of claim 16, further comprising an absorbent material in contact or configured to move into contact with a portion of the groove on the second side surface of each head mount of the adjacent printhead modules.

19. The printhead assembly of claim 18, wherein the absorbent material includes a laterally extending main portion that contacts the portion of the groove on the second side surface of each head mount portion, and a tapered portion projecting downwardly from the laterally extending main portion.

20. The printhead assembly of claim 18, further comprising a motor coupled to the absorbent material and a controller configured to cause the motor to move the absorbent material into contact with the portion of the groove on the second side surface of each head mount.

* * * * *